US005174146A

United States Patent [19]

Heurteboust et al.

[11] Patent Number: 5,174,146

[45] Date of Patent: Dec. 29, 1992

[54] METHOD AND DEVICE FOR FORMING A PART IN RELIEF ON A SHEET METAL BLANK

[75] Inventors: Gerard Heurteboust, Roussy Le Village; Jean-Francois Seconde, Metz, both of France

[73] Assignee: Sollac, Puteaux, France

[21] Appl. No.: 672,957

[22] Filed: Mar. 21, 1991

[30] Foreign Application Priority Data

Apr. 3, 1990 [FR] France ..... 90 04264

[51] Int. Cl.[5] ..... B21P 22/28

[52] U.S. Cl. ..... 72/348; 72/379.2; 72/379.6

[58] Field of Search ..... 72/347, 348, 349, 379.2, 72/379.4, 379.6

[56] References Cited

U.S. PATENT DOCUMENTS

| | | | |
|---|---|---|---|
| 610,532 | 9/1898 | Harmatta | 72/356 |
| 756,404 | 4/1904 | Polte | 72/348 |
| 3,685,338 | 8/1972 | Hoffman | 72/348 |
| 4,134,284 | 1/1979 | Nitschke | 72/106 |
| 4,685,322 | 8/1987 | Clowes | 72/348 |

FOREIGN PATENT DOCUMENTS

| | | | |
|---|---|---|---|
| 0570608 | 2/1959 | Canada | 29/1.3 |
| 0594670 | 9/1925 | France | 72/348 |
| 2083394 | 12/1971 | France . | |
| 2164703 | 8/1973 | France . | |
| 2255115 | 7/1975 | France . | |
| 0435036 | 7/1974 | U.S.S.R. | 72/348 |
| 1233990 | 5/1986 | U.S.S.R. | 72/348 |
| 1349835 | 11/1987 | U.S.S.R. | 72/348 |

*Primary Examiner*—David Jones

*Attorney, Agent, or Firm*—Frishauf, Holtz, Goodman & Woodward

[57] ABSTRACT

The method forms a part in relief on a sheet metal blank (10) by means of a die and a punch. There are carried out on at least a localized zone of the blank (10 of FIG. 2), whose dimension exceeds the dimension of the part in relief, a preforming operation and a shaping operation resulting in the forming of the part in relief. In the course of the preforming operation, a succession of stepped undulations are progressively produced in an intermediate zone of the localized zone located between the future high part of the part in relief and the periphery of the localized zone, and, in the course of the shaping operation, the stepped undulations of the intermediate zone are progressively unfolded and the part in relief is simultaneously formed. The invention also provides a device for carrying out this.

8 Claims, 5 Drawing Sheets

METHOD AND DEVICE FOR FORMING A PART IN RELIEF ON A SHEET METAL BLANK

BACKGROUND OF THE INVENTION

The present invention relates to a method and a device for forming a part in relief on a sheet metal blank, for example a rivet of a so-called easily opened cover for metal boxes or various containers.

The present invention also relates to a product comprising a part in relief obtained by the method according to the invention.

DETAILED DESCRIPTION

The methods for forming a part in relief on a sheet metal blank employed up to the present time comprise carrying out a succession of press operations by means of a plurality of die and punch sets so as to progressively form rough shapes until said part in relief is finally obtained.

The accompanying FIG. 1 represents diagrammatically the different steps of a conventional forming method.

First of all, as shown in FIG. 1 a planar sheet metal blank 1 is placed in a first die 2 and punch 3 set so as to achieve, by the moving together of said die 2 and said punch 3, an expansion of the sheet metal blank in a localized zone by forming a first rough shape 1*a* in the form of a bubble (FIG. 1*a*).

Thereafter, this first rough shape 1*a* is placed in a second die 4 and punch 5 set (FIG. 1*b*) so as to achieve a first shrink drawing forming a second rough shape 1*b*, then this second rough shape 1*b* formed in this way is placed in a third die 6 and punch 7 set (FIG. 1*c*) so as to effect a second shrink drawing which forms a third rough shape 1*c*, and this third rough shape 1*c* is finally placed in a fourth die 8 and punch 9 set (FIG. 1*d*) so as to obtain the final part in relief 1*d*, said punch 9 having dimensions which are substantially equivalent to those of said part in relief.

It can therefore be seen that this known method requires four successive stages and this multiplies the operations for handling and transferring the sheet metal blanks between each stage and thus increases the cost of the finished product.

Moreover, with this known method, there occurs, in the course of the different forming stages, a localized thinning down of the metal, more particularly at the top of the part in relief, which may produce, after forming, a fracture of the metal in particular in the case of a hammering of said part in relief for the riveting of a pulling ring of an easily opened lid.

This thinning down is due to a concentration of the deformations in a limited zone of the sheet metal blank in the course of the successive forming stages.

Owing to this drawback, the method employed heretofore does not permit the use of thin materials and in particular thin and highly work-hardened irons.

Indeed, the thin irons, which are usually highly work-hardened, are characterized by their stiffness and their poor aptitude for deformation so that the expansion forming is found to be very difficult to achieve, since the metal at the periphery of the part in relief does not participate in the deformations and a fracture of the metal usually occurs at the top of said part in relief.

Now, it is known that the use of thin and highly work-hardened irons, for example in the case of easily opened covers, presents many advantages which are in particular a reduced thickness of the covers and therefore a saving in weight, a decrease in the opening forces and an improvement in the feasibility of the lines of reduced resistance on the cover.

It has already been proposed, in document FR 2 164 703, to solve this problem by forming, in the zone surrounding the rivet, an annular beading in the form of an undulation so as to draw the metal in this zone and render the metal available for the subsequent formation of the rivet. However, this method is not applicable to very thin and highly work-hardened irons, since the undulation formed on each side of the plane of the blank is not sufficient to create the supplementary area required for the forming of the rivet, and if the amplitude of the undulation is accentuated in an attempt to obtain this area, there is a risk of fracture of the blank by the excessive localized drawing toward the crests of the undulation. Moreover, the undulation thus formed on each side of the plane of the blank cannot be correctly put back into shape in the course of the operation for finally forming the rivet without risk of a supplementary drawing of the iron which has already been work-hardened to the limit of fracture.

SUMMARY OF THE INVENTION

The present invention has in particular for object to overcome these drawbacks by providing a method for forming a part in relief on a sheet metal blank by means of a die and a punch, said method comprising carrying out a preforming operation on at least one localized zone of the sheet metal blank whose dimension exceeds that of said part in relief, then carrying out a shaping operation by forming said part in relief, comprising:

in the course of the preforming operation, there is produced progressively, in an intermediate zone of said localized zone located between the future high part of said part in relief and the periphery of said localized zone, a succession of stepped undulations;

in the course of the shaping operation, the stepped undulations of said intermediate zone are progressively unfolded and said part in relief is simultaneously formed.

According to another feature of the invention, the area of the preformed localized zone is substantially equivalent to that of said localized zone after the final forming.

The present invention also provides a device for forming a part in relief on a sheet metal blank including a die and a punch, the device comprising a preforming die and punch set each provided with impressions of complementary shape for producing, in a localized zone of said sheet metal blank, a succession of stepped undulations, and a die and punch set for shaping said part in relief.

According to other features of the invention:

the impressions of the preforming die and punch set are formed by a series of projections and hollows;

said projections and said hollows of the preforming die have a height which increases in the direction from the centre toward the periphery of said die;

said projections and said hollows of the preforming punch have a height which decreases in the direction from the centre toward the periphery of said punch;

the shaping punch comprises means for controlling the shrink drawing of the sheet metal blank in the course of the unfolding the stepped undulations and the shaping of the part in relief;

the means controlling the shrink drawing are constituted by movable rings put under pressure, for example by springs.

The present invention also provides a product comprising a part in relief, such as a rivet of a so-called easily opened cover produced by the aforementioned method.

According to other features of the invention:

the product is produced from a thin, highly work-hardened iron sheet blank;

the sheet metal blank has a thickness of between 0.10 and 0.20 mm.

BRIEF DESCRIPTION OF THE DRAWINGS

Further features and advantages of the invention will be apparent from the following description which is given by way of example with reference to the accompanying drawings in which.

DETAILED DESCRIPTION

Figure 1:
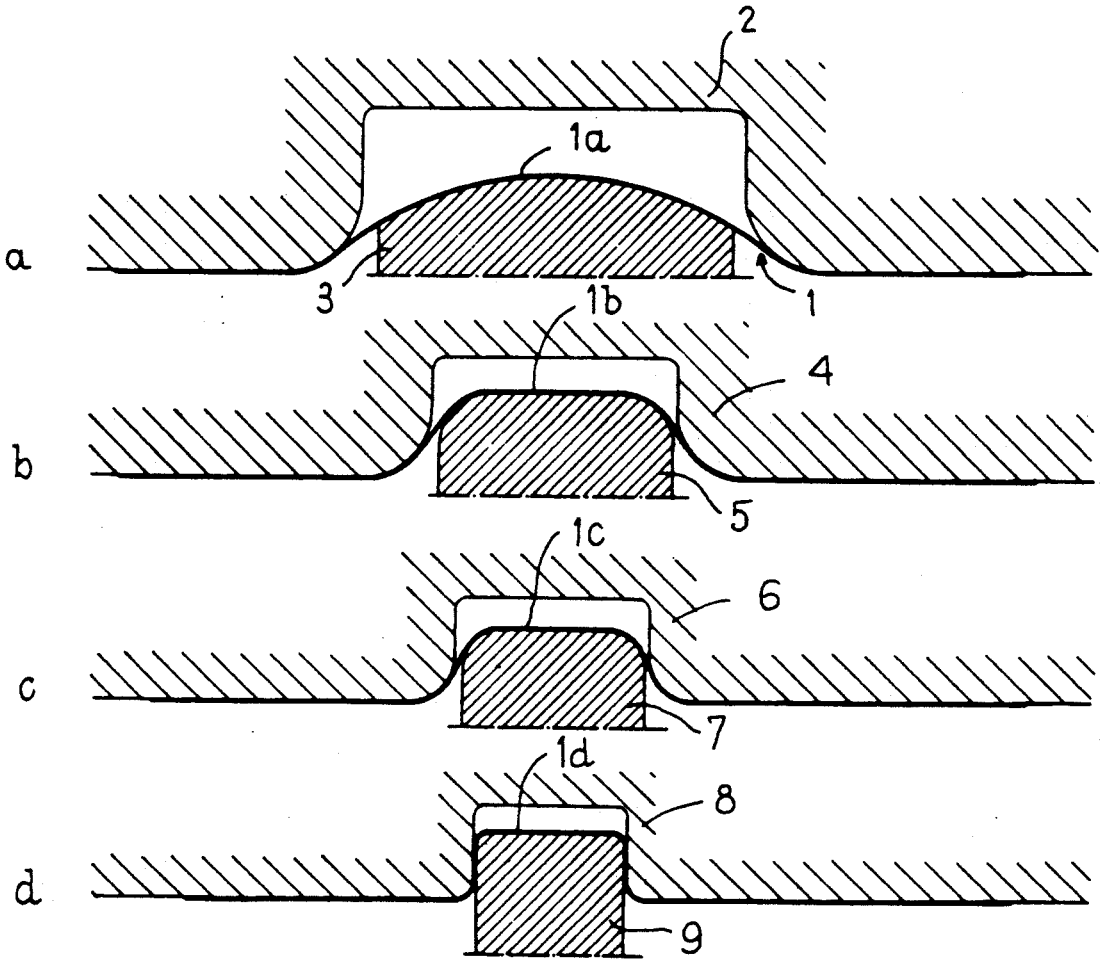
FIG. 1 represents the different stages for forming a part in relief with a device according to the prior art.
Figure 2:
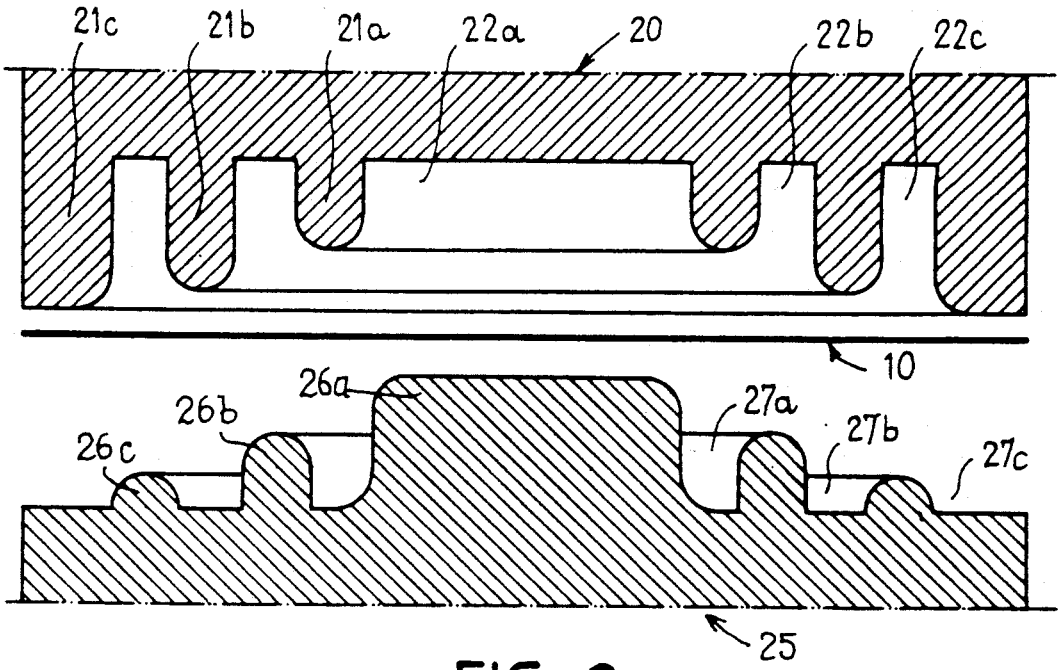
FIG. 2 represents diagrammatically in section the preforming die and punch set of the device according to the invention.
Figure 3:
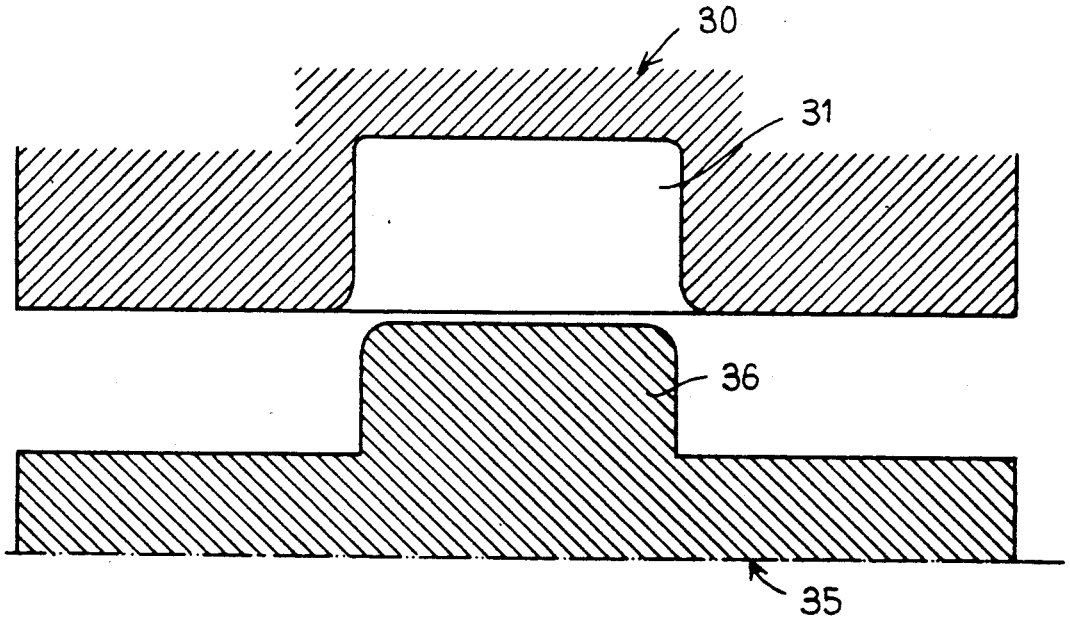
FIG. 3 represents diagrammatically in section the shaping die and punch set of the device according to the invention.

With reference first of all to FIGS. 2 and 3, it can be seen that the device according to the invention for forming a part in relief on a sheet metal blank 10, such as a rivet of a so-called easily opened cover, comprises a preforming set consisting of a die and punch respectively 20 and 25 (FIG. 2), and a set consisting of a shaping die and punch respectively 30 and 35 (FIG. 3).

The preforming die 20 and punch 25 comprise impressions of complementary shape so as to produce, as will be seen hereinafter, a succession of undulations on a localized zone of the sheet metal blank 10.

Thus, the impressions of the preforming die 20 are formed by a series of projections 21*a*, 21*b* and 21*c* and hollows 22*a*, 22*b* and 22*c* for example three in number whose height increases in the direction from the centre toward the periphery of said die 20.

The impressions of the preforming punch 25 are formed by a series of projections 26*a*, 26*b* and 26*c* and hollows 27*a*, 27*b* and 27*c* whose height decreases in the direction from the centre toward the periphery of said punch 25.

The projection 26*a* of the punch 25 and the hollow 22*a* of the preforming die 20 have a shape which is substantially equivalent to the shape of the part in relief it is desired to obtain on the sheet metal blank 10.

For example, and in the case of the forming of a rivet on the sheet metal blank 10, the projecting part 26*a* of the punch 25 and the hollow 22*a* of the die 20 have a cylindrical shape and the projections 21*a*, 21*b*, 21*ck* and 26*a*, 26*b*, 26*c* respectively of the die 20 and the punch 25 are formed by radial rings.

The shaping die 30 of FIG. 3 comprises an impression 31 and the shaping punch 35 has a projection 36 which has a shape complementary to that of said impression 31 and is also identical to the shape of the part in relief it is desired to obtain on the blank 10.

The forming method according to the invention comprises two successive operations, a preforming operation by means of the die 20 and the punch 25 and a shaping operation by means of the die 30 and the punch 35.

Figure 4:
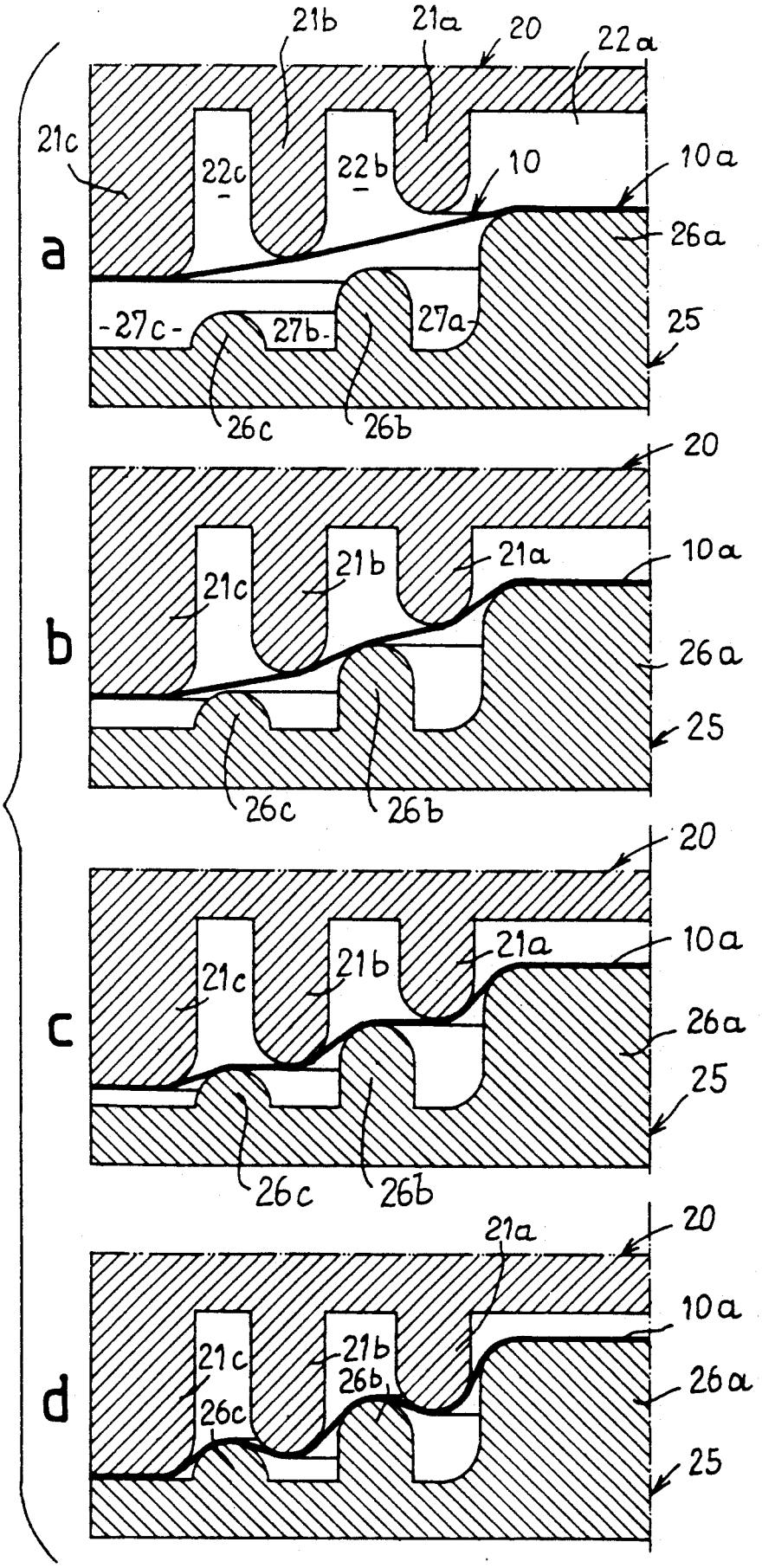
FIGS. 4*a* to 4*d* are diagrammatic semi-sectional views of the successive preforming stages with the device according to the invention.
Figure 5:
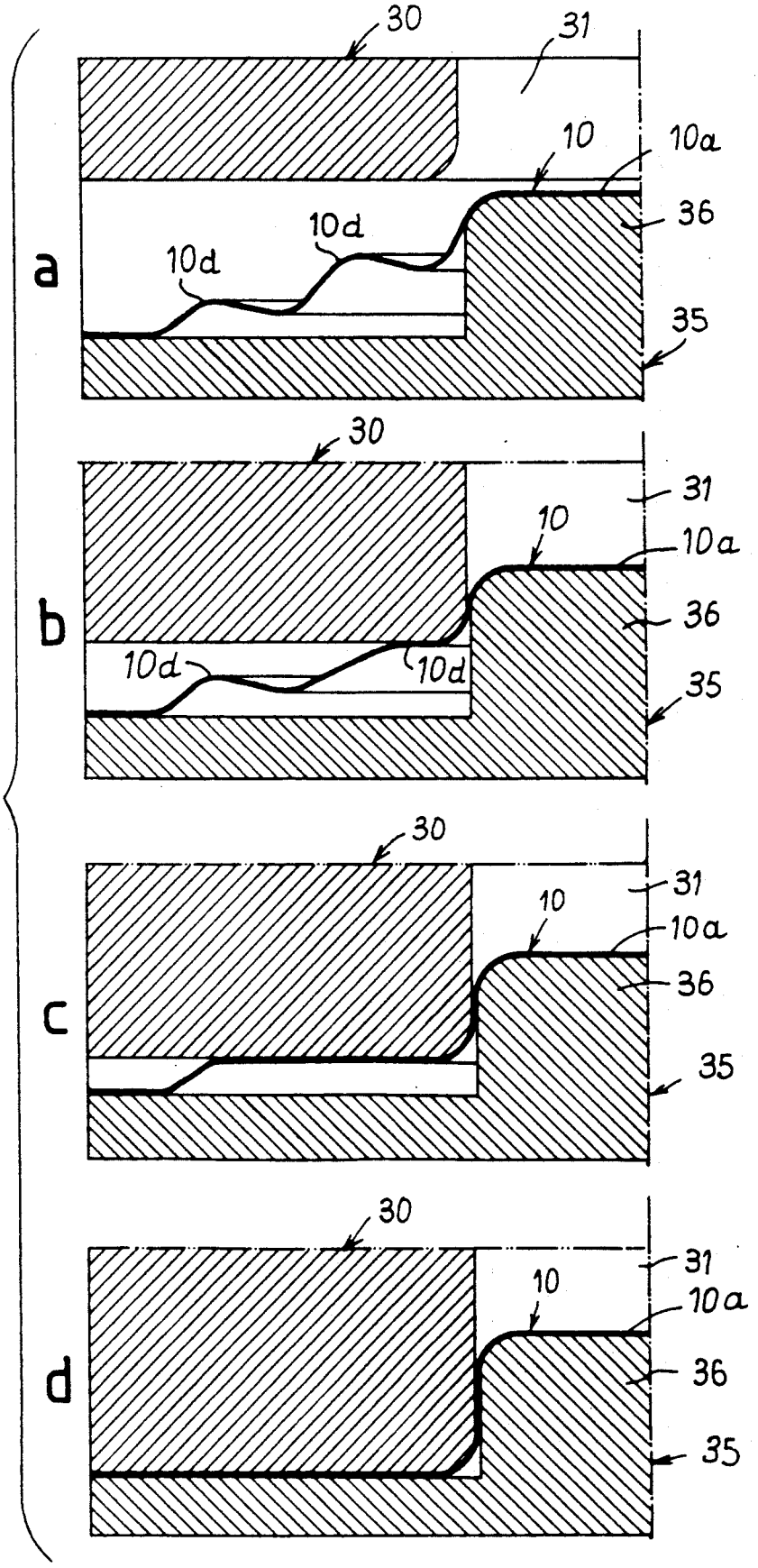
FIGS. 5*a* to 5*d* are diagrammatic semi-sectional views of the successive shaping stages with the device according to the invention.

With reference to FIGS. 4 and 5, these two operations will now be described.

First of all, the planar sheet metal blank 10 is placed between the die 20 and the preforming punch 25, said sheet metal blank being held, for example, by peripheral blank holders (not shown).

The die 20 descends and, at the beginning of the pressing operation, the projection 21*c* comes into contact with the blank 10 which is itself in contact with the projection 26*a* of the punch 25 (FIG. 4*a*).

This first stage permits determining on the blank 10 a localized zone A (FIG. 6) in which the stresses will be uniformly distributed, whereas the peripheral zone of the blank surrounding the localized zone A, which is maintained pressed by the blank holder, is not drawn and undergoes no deformation.

Thereafter, the die 20 continues to descend so that the projections 21*b*, 26*b* and 21*a*, 26*c* come into contact with the blank 10 (FIG. 4*b*), then progressively interpenetrate (FIG. 4*c*) until the moment when the highest projection, i.e. the projection 21*c*, comes to bear in the hollow 27*c* of the punch 25.

Thus a succession of undulations 10*d* arranged in steps (FIG. 6) is formed in an intermediate zone B of the localized zone A of the blank 10 located between the future high part 10*b* of the part in relief 10*a* to be formed and the periphery of the localized zone A.

This preforming operation therefore causes the material to be deformed in several regions and permits dividing up the area to be deformed into several annular sections.

At the start of the pressing operation, the material thins down in the region where the projection or projections bear thereagainst and, in the course of the forming of the stepped undulations, the initial deformations are maintained blocked under the effect of the contact of said projections.

At the end of the operation, the deformations are developed along radii then in the parts left free between the projections.

Further, the area of the preformed localized zone A is substantially equivalent to said localized zone after the final forming of the part in relief.

Figure 6:
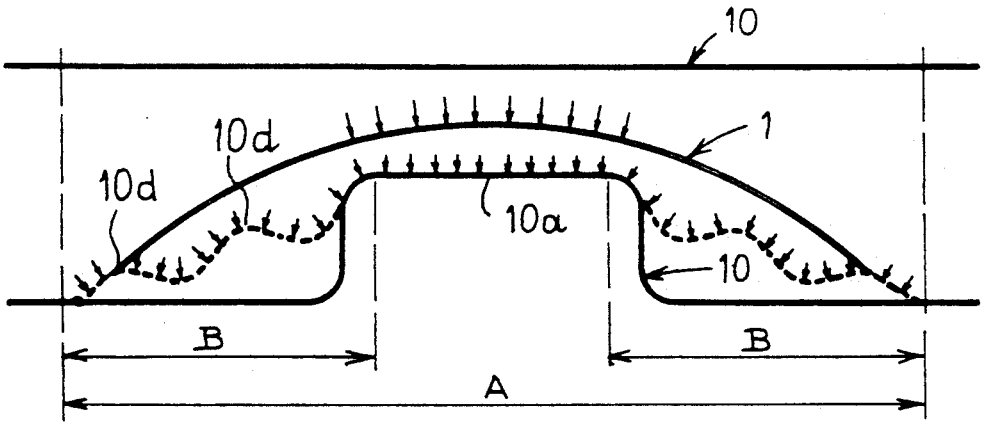
FIG. 6 is a diagram showing the distribution of the stresses on the sheet metal blank, on one hand with the method according to the prior art, and on the other hand with the method according to the invention.

Owing to this arrangement, and as can be seen in FIG. 6, the stresses are uniformly distributed in the zone A of the blank 10, whereas, in the prior art, the stresses are more particularly concentrated in the region of the top of the part in relief formed on the blank 1.

In the course of the second operation shown in FIGS. 5*a* to 5*b*, there is produced, after the positioning of the preform of the blank 10 between the die 30 and the shaping punch 35 (FIG. 5*a*), a shrink drawing in accordance with the shape given by the projection 36 of said punch 35.

To this end, the die 30 is progressively lowered so as to achieve a successive unfolding of the undulations 10*d* (FIGS. 5*b* and 5*c*) until the part in relief 10*a* (FIG. 5*d*) is finally formed, the metal of said intermediate zone, to the exclusion of that used for constituting the lateral area of the part in relief, then being brought substantially into the plane of the blank.

Owing to the successive unfolding of the undulations 10*d*, a sufficient retention is created to facilitate the passage of the material into the impression 31 of the die 30.

Figure 7:
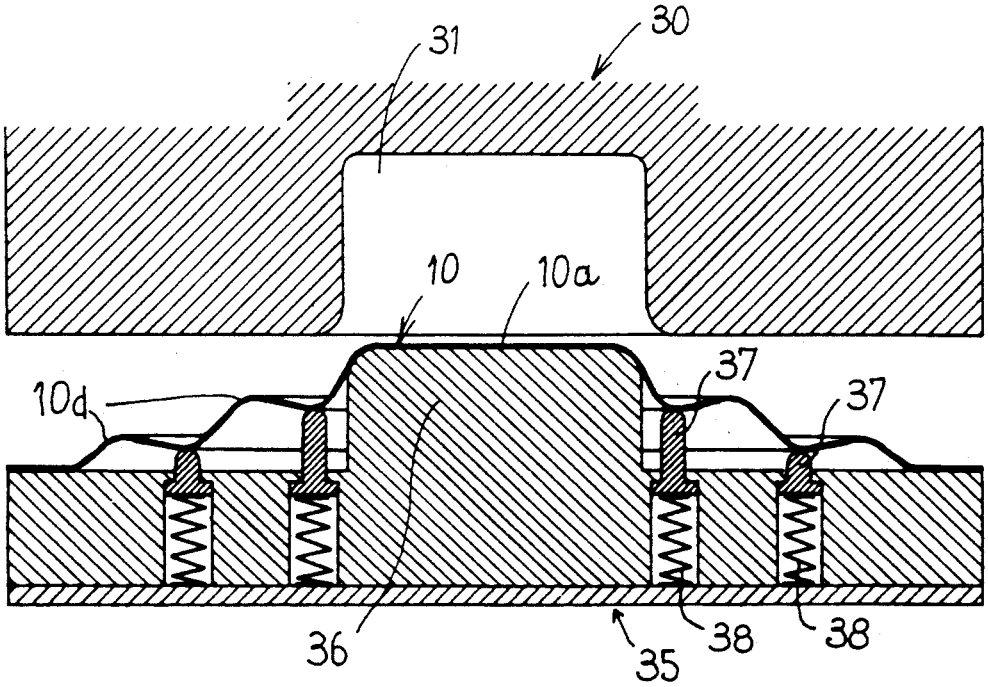
FIG. 7 is a diagrammatic sectional view of a variant of the shaping die and punch set of the device according to the invention.

In the variant shown in FIG. 7, the shaping punch 35 comprises means for controlling the shrink drawing of the blank 10 in the course of the unfolding of the undulations 10*d* and the shaping of the part in relief 10*a*.

These control means are formed by rings 37 disposed either in the region of the projections or in the region of the hollows of the undulations 10*d* and put under pressure, for example by springs 38.

The method and the device according to the invention therefore permits forming a part in relief on a sheet metal blank in two operations, whereas the methods of the prior art require three to four successive operations.

The invention is applicable to all types of material and permits the use of highly work-hardened thin irons having a thickness of 0.10 to 0.20 mm, in particular for producing easily opened covers of metal boxes or various containers.

Owing to the use of this type of material, the covers are thinner and this results in a saving in weight, lower cost and less effort for opening the covers.

Further, it also permits improving the feasibility of the lines of reduced resistance provided on these covers and decreasing the depth of these lines.

The invention is applicable not only to the forming of parts in relief of circular section, such as rivets for covers, but also to the forming of parts in relief of any section or of a section which may vary as a function of the height of said part in relief.

While the invention has been described with reference to the drawings and structures and method disclosed herein, it is not confined to the details set forth, and is intended to cover modifications or changes as may come within the scope of the following claims.

What is claimed is:

1. A method for forming a raised portion on a thin work-hardened sheet metal blank, the sheet metal blank having a given thickness and a given dimension, said raised portion being raised in a direction of said given thickness of said sheet metal blank, comprising:

providing one die and one punch and carrying out a preforming operation on at least a localized zone of the sheet metal blank with said one die and said one punch to form a plurality of stepped undulations on said sheet metal blank, the given dimension of said sheet metal blank exceeding a dimension of said raised portion to be formed on said sheet metal blank; and then carrying out a shaping operation on said plurality of stepped undulations with another die and another punch for forming said raised portion on said sheet metal blank;

said preforming and shaping operations both being press operations;

said preforming operation including:

progressively producing a succession of said plurality of stepped undulations on said sheet metal blank by use of said one die and said one punch, said plurality of stepped undulations being formed in an intermediate zone of said localized zone, said given thickness of said sheet metal blank being reduced in said intermediate zone;

said intermediate zone being located between a position on said sheet metal blank where said raised portion is to be formed on said sheet metal blank and a periphery of said localized zone;

said localized zone further being surrounded by undeformed portions of said sheet metal blank; and said plurality of stepped undulations being formed by pressing said one die only on one side of said sheet metal blank; and said shaping operation including:

progressively unfolding said plurality of stepped undulations at said intermediate zone by using said another die and said another punch and simultaneously forming said raised portion on said sheet metal blank.

2. The method according to claim 1, wherein an area of said localized zone after the preforming operation, is substantially equal to an area of said localized zone after the shaping operation.

3. The method according to claim 1, wherein the sheet metal blank comprises a thin, highly work-hardened iron sheet metal blank.

4. The method according to claim 3, wherein said sheet metal blank has a thickness of 0.10 to 0.20 mm.

5. A device for forming a raised portion on a thin, work-hardened sheet metal blank having a given thickness and a given dimension, said raised portion being raised in a direction of the given thickness of the sheet metal blank, said device comprising:

a preforming die and punch set; and a shaping die and punch set;

each of said preforming die and punch of said preforming die and punch set respectively being provided with complementary shaped ridges and grooves, which when moved against the sheet metal blank, form a succession of stepped undulations on a localized zone of said sheet metal blank, said stepped undulations reducing the given thickness of the sheet metal blank in said localized zone, said ridges and grooves of said preforming die and punch set comprising a series of projections and hollows, aid projections and said hollows of the preforming die having a height which increases in a direction from a center of said preforming die toward a periphery of said preforming die, and said projections and said hollows of the preforming punch having a height which decreases in a direction from a center toward a periphery of said preforming punch; and said shaping die and punch set includes shaping surface means for shaping said stepped undulations formed by said preforming die and punch set, by progressively unfolding the stepped undulations and simultaneously forming said raised portion on said sheet metal blank.

6. A device according to claim 5, wherein said shaping punch set comprises control means for controlling a shrink drawing of said sheet metal blank during an unfolding of said stepped undulations and a shaping of said raised portion of the sheet metal blank.

7. A device according to claim 6, wherein said shrink drawing control means comprises movable rings and pressure applying means for applying a pressure on said rings.

8. A device according to claim 7, wherein said pressure applying means comprises springs.

* * * * *